United States Patent [19]

Laskey

[11] Patent Number: 4,553,454

[45] Date of Patent: Nov. 19, 1985

[54] NUT RETAINING SOCKET WITH REPLACEABLE NUT RETAINER

[75] Inventor: Daniel A. Laskey, Saugus, Mass.

[73] Assignees: Charles D. Lancaster, Saugus; Richard F. Laskey, Malden, both of Mass.

[21] Appl. No.: 555,532

[22] Filed: Nov. 28, 1983

[51] Int. Cl.[4] ..... B25B 13/02

[52] U.S. Cl. ..... 81/125

[58] Field of Search ..... 81/124.1, 125, 448, 81/452, 454

[56] References Cited

U.S. PATENT DOCUMENTS

| | | | |
|---|---|---|---|
| 851,181 | 4/1907 | McMurtry | 81/125 X |
| 1,509,680 | 9/1924 | Meek | 81/124.1 |
| 2,502,025 | 3/1950 | Raup | 81/125 |
| 2,798,394 | 7/1957 | Hubbard | 81/125 |
| 2,834,241 | 5/1958 | Chowning | 81/125 |
| 3,207,010 | 9/1965 | Wendling | 81/125 |
| 3,789,706 | 2/1974 | Smith | 81/125 X |
| 3,855,883 | 12/1974 | Stumpf et al. | 81/125 |
| 4,007,768 | 2/1977 | Matsushima | 81/448 |

*Primary Examiner*—Frederick R. Schmidt
*Assistant Examiner*—Debra S. Meislin
*Attorney, Agent, or Firm*—Pahl, Lorusso & Loud

[57] ABSTRACT

A nut retaining socket wrench with a replaceable, resilient nut bore retainer. The nut bore retainer consists of a recessed, cylindrical piece containing an offset looped spring within the socket. A set screw and support plate confine the retainer to the socket without infringing on its mobility. A helical spring provides the moving force for the retainer. The offset spring applies pressure to the side of the nut bore to position and retain the nut until displaced by the bolt. The nut is therefore held within the socket both while it is being screwed onto and off of the bolt.

4 Claims, 4 Drawing Figures

NUT RETAINING SOCKET WITH REPLACEABLE NUT RETAINER

BACKGROUND OF THE INVENTION

The invention relates generally to socket wrenches and particularly to a socket with a replaceable, resilient nut bore retainer.

Nut retaining wrenches have been in use for a number of years. There is an obvious advantage to a socket that can secure a nut during removal and positioning onto a shaft. This is particularly true when the nut is to be placed in a restricted space or in a device such as a jet engine, in which a single dropped nut can be disasterous.

U.S. Pat. No. 3,207,010 to LeRoy J. Wendling and U.S. Pat. No. 3,834,241 to D. K. Chowning discuss magnetic socket wrenches. The first uses a resilient magnet within the socket and the second has a magnet as a part of the socket. The present invention avoids the use of a magnet because of possible disruption by electrical or magnetic fields within the work area.

U.S. Pat. No. 3,789,706 to William S. Smith teaches the use of a nut retaining socket wrench for use with power tools. The nut is retained by a rather specific clutch jaw. The disadvantage of this device is that it is designed for use with a power drive tool, it is complicated and bulky, and it is not easily adaptable for use with various types of nuts.

U.S. Pat. No. 3,855,883, to Stumpf and Laskey describes a simple, variable and reliable nut retaining socket. A resilient insert holds the nut by use of a plastic plug on the nut engaging end. The difficulty encountered with the use of this device was the fairly rapid disintegration of the plastic nut bore engaging piece from repeated engagement with the nut bore. Since the insert could not be removed and replaced without special tools, the entire socket had to be replaced.

It is therefore a principle object of the present invention to provide an improved nut retaining tool.

A further object of the present invention is to provide an improved socket wrench having durable means for releasably engaging a nut.

Still another object of this invention is to provide a nut retaining socket wrench which is highly compact and capable of reaching tightly confined locations.

Another principal object of this invention is to provide a nut retaining tool of the above nature in which the nut engaging means is reliable, adaptable and easily replaceable.

SUMMARY OF THE INVENTION

A wrench of this invention consists of a handle connected to a nut engaging socket. The socket contains a resilient cylindrical nut bore engaging insert. The socket may be varied as necessary according to the nut to be used. A helical compression spring forces the insert out of the socket into the nut bore. An offset spring in the insert exerts pressure against the side of the nut bore, securing the nut. A set screw penetrates the side of the socket to retain the insert but does not enter so far as to prevent all longitudinal movement of the insert. The insert may be easily removed by unscrewing the set screw.

The improved nut engaging wrench is compact, durable and repairable. The offset spring lasts longer than a plastic tip. The insert may be easily removed and replaced if a problem does arise. The long term cost of using this device is less because the socket can be reused even if the insert wears out. Because numerous types of nuts may be used with this type of socket and nut-bore retainer, the improved socket wrench is highly versatile, adaptable and of wide application.

These and other features and objects will become apparent to those skilled in the art from the following detailed description which should be read in light of the accompanying drawings.

DETAILED DESCRIPTION OF THE PREFERRED EMBODIMENT

Figure 1:
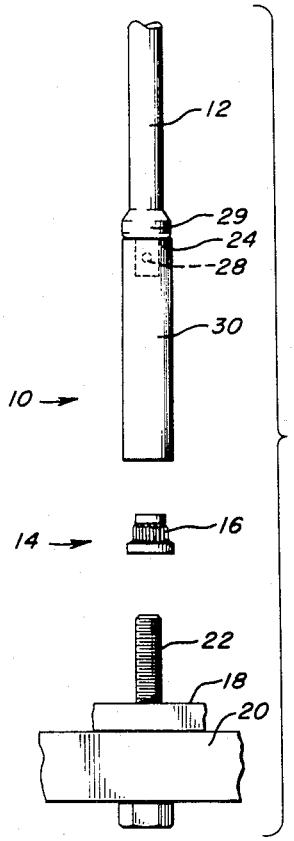
FIG. 1 is an exploded perspective view of the present invention positioned above a nut used to secure two plates with a bolt.

Referring to FIGS. 1 to 4, the embodiment of the invention illustrated therein shows a nut engaging insert and socket. In FIG. 1, a nut retaining socket wrench 10 has a longitudinally extending handle 12 and is employed with a nut 14 having a serrated upper peripheral surface 16. Nut 14 is shown by way of example for use in securing two pieces 18 and 20, with a bolt 22 through the aligned bores. The handle 12 is attached to the socket at the tool-engaging end via a rectangular shaft 24 on the end of the handle which fits into a socket 26 (see FIG. 2). In FIG. 1, interfitting spring detents 28 in the extension piece 24 couple the handle 12 to the nut retaining socket 30 at the interfitting depressions 27 (see FIG. 2). A shoulder 29 on the handle helps position the nut retaining socket 30.

Figure 2:
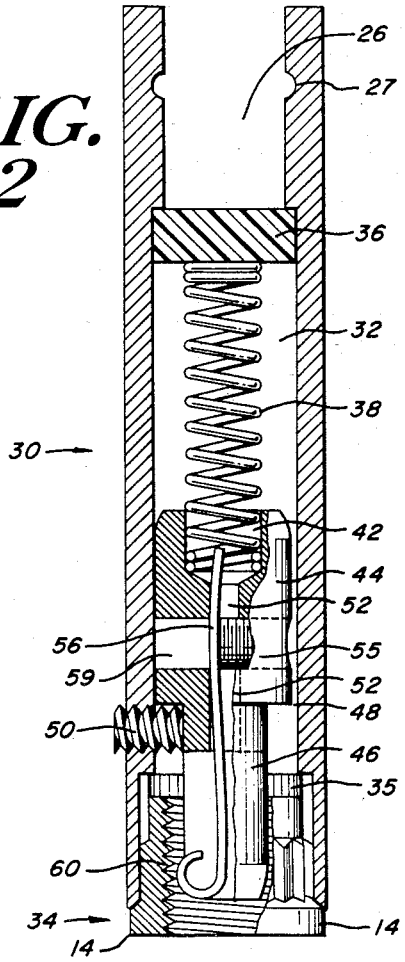
FIG. 2 is a cross-sectional view of the nut-engaging socket of the present invention.
Figure 4:
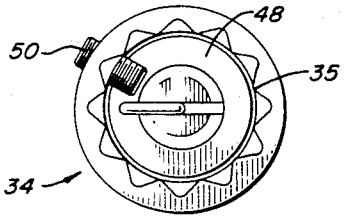
FIG. 4 is a bottom plan view of the nut bore engaging insert within the socket of the present invention with the nut removed.
Figure 3:
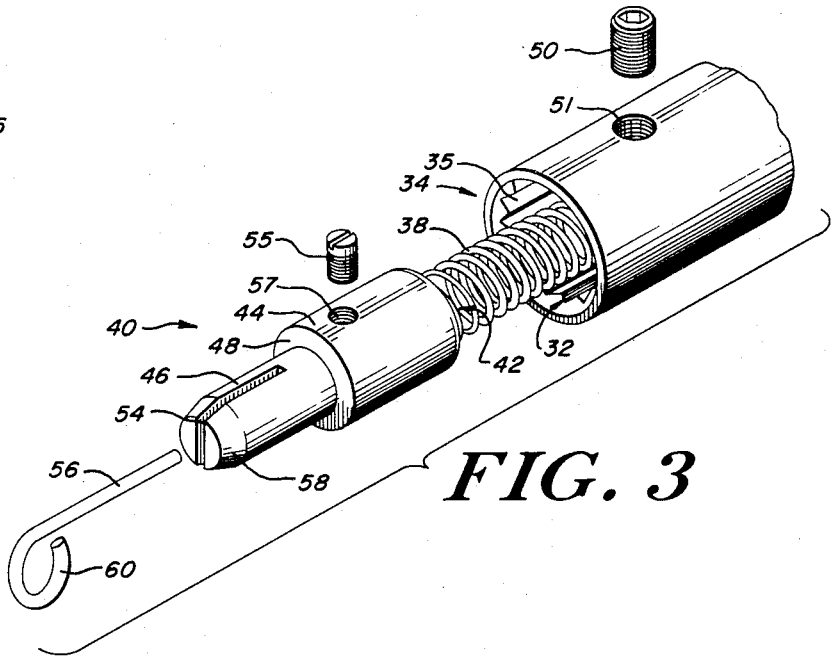
FIG. 3 is an exploded perspective view of the nut bore engaging insert within the socket.

FIGS. 2, 3 and 4 provide expanded plan and cross-sectional views of the nut engaging socket 30. The nut engaging socket 30 is of known construction. It consists of a cylindrical piece with a long central bore 32 running from the bottom of the tool engaging socket 26 to the nut engaging end 34. Serrations 35 in the nut engaging end 34 prevent the nut 14 from turning within the socket 30. A spring support plate 36 separates bore 32 from the tool engaging socket 26.

A helical compression spring 38 is the moving force for the nut retaining insert 40. The spring attaches to the nut retaining insert 40 by way of a circular cavity 42 within the base of the insert.

The insert 40 is formed from a single cylindrical piece consisting of a portion 44 whose diameter is slightly less than that of the central bore 32 and a smaller portion 46 whose diameter is slightly less than the bore size of the nuts to be secured. A shoulder 48 formed at the junction of these pieces is impinged on by a set screw 50, confining the insert 40 within the socket 30. When viewed from the bottom, as in FIG. 4, it can be seen that the screw 50 protrudes through a hole 51 in the socket, past the outer edge of 44 but not as far in as the outer diameter of 46. This allows the insert 40 to move freely even though it is unable to come out of the socket 30.

The insert 40 has a small diameter bore 52 running from its nut bore engaging end to the compression spring cavity 42. The lower half of the insert portion 46 is also slotted at 54. This allows a looped spring 56 to be placed in the bore 52 so that as it moves within the plane of slot 54, it can releasably engage a nut 14. A screw 55 is inserted into a tapped bore 57 to hold the spring. As is shown in FIG. 2, the screw 55 is just long enough to press the spring 56 against the wall of bore 52 to secure it for nut engagement. The tapped bore is part of a longer bore 59 through the insert portion 44. The non-tapped part of bore 59 has a larger diameter to facilitate removal of the threading tap during manufacture of the insert.

The diameter of the insert portion 46 is determined for the size nut bore to be used with the socket 30. The end part of the insert portion 46 is angled at 58 to facilitate entry into the nut bore. Once the insert portion 46 is positioned within the nut bore, the looped spring 56 exerts pressure sufficient to releasably hold the nut in the socket. As shown in FIG. 2, this is accomplished by the curled portion 60 of spring 56 protruding beyond the outside diameter of portion 46 to urge against the nut 14.

The improved nut retaining wrench works in a simple fashion. The handle 12 is snapped into the tool engaging socket 26. The nut retaining socket 30 is slipped over the nut 14. The nut retaining insert 40 is urged toward the nut retaining end of the socket 30 by the compression spring 38 to resiliently contact a nut 14. The serrations 35 on the end of the socket 30 engage the nut serrations 16 to prevent the nut from slipping around in the socket. As the angled, small diameter portion 58 of the insert 46 enters the nut bore, the offset looped spring 56 moves in the slot 54 until it is pressing securely against the side of the nut bore. As the nut is screwed onto the bolt 22, the insert piece 40 is displaced back into the socket 30. When the nut is firmly in place, the socket 30 is easily lifted off of the nut since spring 56 no longer engages it.

The reverse occurs when a nut 14 is unscrewed from a bolt 22.

Although this invention has been described with reference to a specific embodiment, it is understood that modifications and variations may occur to those skilled in the art. It is intended that all such modifications and variations be included within the scope of the appended claims.

What is claimed is:

1. A nut retaining socket which comprises:

(a) a housing member having wall means defining a central bore, wherein one end of said housing member is a tool engaging socket and the other end is a nut engaging socket, said housing member having a support plate separating said tool engaging socket from said central bore and a removable detent protruding through said member into said central bore;

(b) a nut engaging insert positioned within said central bore, said insert having a nut bore engaging end of a first diameter slightly less than the diameter of a nut bore to be engaged, a radial slot in said nut bore engaging end and an opposite end of larger diameter than said nut bore engaging end, whereby a shoulder is formed at the junction of the larger diameter end of said insert with the smaller diameter nut engaging end of said insert;

(c) a spring member having one end secured within said insert and a second end extending into said radial slot, said second end of said spring member being movable across said slot and being biased radially outward for securing a nut within said nut engaging socket by pressing the nut against said wall means; and (d) a compression spring, resiliently urging said insert away from said support plate towards said nut engaging socket, whereby said detent contacts said shoulder to confine said insert within said central bore of said member;

wherein withdrawal of said detent from said central bore permits removal of said insert.

2. The nut retaining socket wrench of claim 1 wherein said nut engaging end of said insert is angled to facilitate entry into said nut bore.

3. The nut retaining socket of claim 1 wherein said slot completely traverses said first diameter.

4. The nut retaining socket of claim 1 wherein said second end of said spring member is formed into loop.

* * * * *